US008853576B2

(12) United States Patent
Sisley et al.

(10) Patent No.: US 8,853,576 B2
(45) Date of Patent: Oct. 7, 2014

(54) CIRCUIT BREAKER, CIRCUIT BREAKER TERMINAL LUG COVER, AND METHOD OF PROTECTING A TERMINAL LUG

(71) Applicant: Eaton Corporation, Cleveland, OH (US)

(72) Inventors: James P. Sisley, Baden, PA (US); Paul A. Merck, Cresent, PA (US); Robert W. Mueller, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 165 days.

(21) Appl. No.: 13/678,785

(22) Filed: Nov. 16, 2012

(65) Prior Publication Data

US 2013/0146430 A1 Jun. 13, 2013

Related U.S. Application Data

(60) Provisional application No. 61/569,726, filed on Dec. 12, 2011.

(51) Int. Cl.

| | |
|---|---|
| ***H01H 9/02*** | (2006.01) |
| ***H01H 77/00*** | (2006.01) |
| ***H01H 69/00*** | (2006.01) |
| ***H01R 13/533*** | (2006.01) |
| ***H01H 71/08*** | (2006.01) |

(52) U.S. Cl.

CPC ..... *H01H 77/00* (2013.01); *H01H 69/00* (2013.01); *H01H 9/0264* (2013.01); *H01R 13/533* (2013.01); *H01H 71/08* (2013.01)

USPC ..... 200/304

(58) Field of Classification Search

USPC ..... 200/302.1, 296, 304; 335/202; 361/673; 439/810

IPC ..... H01H 9/0264

See application file for complete search history.

(56) References Cited

U.S. PATENT DOCUMENTS

| | | | |
|---|---|---|---|
| 4,620,076 | A | 10/1986 | Mrenna et al. |
| 4,809,132 | A | 2/1989 | Palmieri et al. |
| 5,111,008 | A | 5/1992 | Oster |
| 5,488,337 | A | 1/1996 | Hubbard et al. |

(Continued)

FOREIGN PATENT DOCUMENTS

| | | |
|---|---|---|
| EP | 17163 B1 | 5/1983 |

OTHER PUBLICATIONS

European Patent Office, "International Search Report and Written Opinion", Mar. 11, 2013, 12 pp.

*Primary Examiner* — Vanessa Girardi

(74) *Attorney, Agent, or Firm* — Eckert Seamans Cherin & Mellott, LLC; Kirk D. Houser

(57) ABSTRACT

A circuit breaker terminal lug cover is structured to mechanically secure to a circuit breaker terminal lug and protect the terminal lug from degradation or corrosion. The terminal lug includes a number of terminal lug screws capable of securing a number of cables to the circuit breaker. The terminal lug cover includes a plurality of sides structured to carry heat away from the terminal lug or deflect ionized gases away from the terminal lug. At least one of the sides includes a number of securing members structured to mechanically secure the terminal lug cover to the circuit breaker terminal lug. One of the sides includes an access hole permitting access to the number of terminal lug screws.

21 Claims, 3 Drawing Sheets

(56) References Cited

U.S. PATENT DOCUMENTS

| | | | | |
|---|---|---|---|---|
| 5,811,749 | A * | 9/1998 | Bausch et al. | 218/157 |
| 6,172,586 | B1 | 1/2001 | Ferree et al. | |
| 6,211,759 | B1 | 4/2001 | Little et al. | |
| 6,838,962 | B2 | 1/2005 | Leone et al. | |
| 6,930,577 | B2 | 8/2005 | Subramanian et al. | |
| 7,786,831 | B2 * | 8/2010 | Oh | 335/202 |
| 2002/0144978 | A1 | 10/2002 | Leone et al. | |
| 2008/0074217 | A1 | 3/2008 | Duchrow et al. | |

* cited by examiner

CIRCUIT BREAKER, CIRCUIT BREAKER TERMINAL LUG COVER, AND METHOD OF PROTECTING A TERMINAL LUG

CROSS REFERENCE TO RELATED APPLICATION

This application claims the benefit of U.S. Patent Application Ser. No. 61/569,726, filed Dec. 12, 2011, which is incorporated by reference herein.

BACKGROUND

1. Field

The disclosed concept pertains generally to heat and corrosion protection devices and, more particularly, to devices used to protect circuit breaker terminals, terminal screw threads, connecting cables, and the like, from heat and corrosion caused by high temperature gases. The disclosed concept further pertains to circuit breakers. The disclosed concept also pertains to methods of protecting circuit breaker terminals, terminal screw threads, connecting cables, and the like.

2. Background Information

Circuit breakers function to interrupt the flow of electric current when an overload or short circuit is detected within a power circuit. When the circuit breaker interrupts the overload or short circuit current, an arc is generated, which creates exhaust gases of high temperature. These ionized exhaust gases can damage the terminal lug of the circuit breaker by causing corrosion. Additionally, the heated exhaust gases can damage the circuit breaker terminal lug by causing connecting cables to melt onto the terminal lug. Corrosion of the terminal lug coupled with melted cable material can damage terminal lug screw threads rendering the threads and terminal lug unusable.

When the cabling connected to a circuit breaker melts onto the terminal lug, such that removal thereof becomes difficult, it is standard practice to cut the damaged cabling. Additionally, when circuit breaker terminal lugs have degraded to such a degree that corrosion and cable melt have made the terminal lug and threads therein unusable, it is standard practice to replace the terminal lug, or in some cases, the entire circuit breaker. Information relevant to attempts to address these problems are found in U.S. Pat. No. 5,111,008. However, it is believed that the teachings found in this Patent suffer from the fact that it is not easily adaptable to interface between a commercial circuit breaker and its terminal lug.

Also, several manufacturers of industrial circuit breakers have produced "terminal shields". These shields are not to be confused with the device to be described hereinbelow. In contrast to the device described by the disclosed concept, "terminal shields" lie between the internal phases of a circuit breaker and protect each phase from the arc of another phase. It is believed that such terminal shields fail to properly address or protect external circuit breaker terminal lugs and connecting cables from such arcing events.

Consequently, a need exists in the art for a method, apparatus, and device capable of preventing such terminal lug degradation or corrosion.

There is room for improvement in circuit breakers.

There is also room for improvement in circuit breaker terminal lugs.

There is further room for improvement in methods of protecting circuit breaker terminal lugs.

SUMMARY

These needs and others are met by embodiments of the disclosed concept in which a circuit breaker terminal lug cover protects a circuit breaker terminal lug and a number of connecting cables from degradation or corrosion (e.g., without limitation, caused by heat and/or ionized exhaust gases).

In accordance with one aspect of the disclosed concept, a circuit breaker terminal lug cover is structured to mechanically secure to a circuit breaker terminal lug and protect the terminal lug from degradation or corrosion, the terminal lug includes a number of terminal lug screws capable of securing a number of cables to the circuit breaker. The terminal lug cover comprises: a plurality of sides structured to carry heat away from the terminal lug or deflect ionized gases away from the terminal lug, wherein at least one of the sides includes a number of securing members structured to mechanically secure the terminal lug cover to the circuit breaker terminal lug, and wherein one of the sides includes an access hole permitting access to the number of terminal lug screws.

As another aspect of the disclosed concept, a circuit breaker apparatus comprises: a circuit breaker comprising: a circuit breaker terminal lug including a number of terminal lug screws capable of securing a number of cables to the circuit breaker; and a circuit breaker terminal lug cover mechanically secured to the circuit breaker terminal lug in order to protect the terminal lug from degradation or corrosion, the terminal lug cover comprising: a plurality of sides structured to carry heat away from the terminal lug or deflect ionized gases away from the terminal lug, wherein at least one of the sides includes a number of securing members mechanically securing the terminal lug cover to the circuit breaker terminal lug, and wherein one of the sides includes an access hole permitting access to the number of terminal lug screws.

The plurality of sides may be a front side, a bottom side, and two opposing sides each of which is coupled to the front and bottom sides. The terminal lug cover may fit snugly on a front side, a bottom side, and two opposing sides of the terminal lug in order that physical contact between the terminal lug cover and the terminal lug permits the terminal lug cover to conduct heat away from the terminal lug and the number of cables or deflect ionized gases away from the terminal lug.

As another aspect of the disclosed concept, a method protects a circuit breaker terminal lug from degradation or corrosion. The circuit breaker terminal lug includes a number of terminal lug screws capable of securing a number of cables to a circuit breaker, and the circuit breaker includes a terminal lug. The method comprises: mechanically securing a circuit breaker terminal lug cover to the circuit breaker terminal lug in order to protect the terminal lug from degradation or corrosion; providing the circuit breaker terminal lug cover with a plurality of sides structured to carry heat away from the terminal lug or deflect ionized gases away from the terminal lug; including with at least one of the sides a number of securing members mechanically securing the terminal lug cover to the circuit breaker terminal lug; and providing one of the sides with an access hole permitting access to the number of terminal lug screws.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" or "affixed" together shall mean that the parts are joined together either directly or joined through one or more intermediate parts. Further, as employed herein, the statement that two or more parts are "attached" shall mean that the parts are joined together directly.

As employed herein, the term "circuit breaker" shall mean any electrical switch or circuit interrupter that interrupts the flow of electrical current in an electrical circuit upon the existence or occurrence of specified number of electrical/mechanical fault conditions, and that permits the flow of electric current in the electrical circuit under other conditions.

As employed herein, the term "circuit breaker terminal" shall mean a component of a circuit breaker that permits a number of cables of a circuit to connect to the circuit breaker.

As employed herein, the term "circuit breaker terminal lug" or "terminal lug" shall mean a physical component of a circuit breaker having a circuit breaker terminal.

As employed herein, the term "hole" shall mean an opening through something; an area where something is missing; or an aperture through something.

As employed herein, the term "access hole" shall mean a hole through or in something to access something else.

As employed herein, the term "screw" shall mean a simple machine of the inclined plane type consisting of a spirally grooved solid cylinder structured to fit into a correspondingly grooved hollow cylinder; a nail-shaped or rod-shaped piece with a spiral groove structured to fit into a correspondingly grooved hollow material by rotating; or a threaded or spirally grooved fastener structured to fit into a correspondingly threaded or spirally grooved terminal lug by rotating.

As employed herein, the term "cable" shall mean a circuit conductor having a number of individual electrical conductors.

The disclosed concept provides advantageous apparatus and devices for protecting circuit breakers from failure, degradation, corrosion, and eventual replacement due to excessive heat resulting from ionized gases released during arcing events. The circuit breaker terminal lug covers described herein prolong the operational lifetime of circuit breakers, and their connecting components. Using the apparatus and devices according to the disclosed concept, thermal energy and/or ionized exhaust gasses are efficiently and effectively conducted away from or deflected away from the circuit breaker and its connecting cables.

Figure 1:
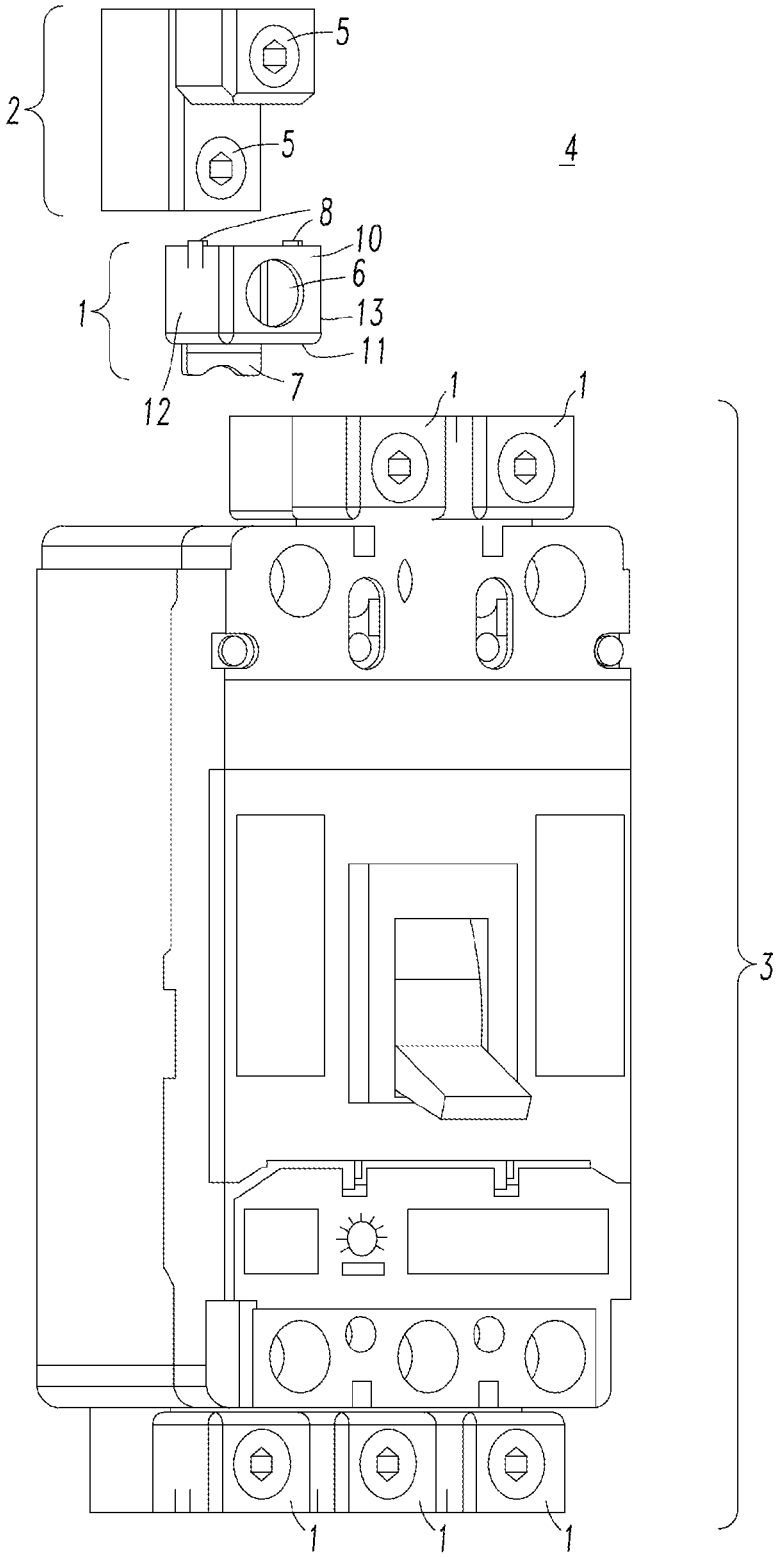
FIG. 1 is a partially exploded isometric view of an electrical circuit breaker, including a circuit breaker terminal lug and a terminal lug cover in accordance with embodiments of the disclosed concept.

FIG. 1 shows an isometric view of one embodiment of an electrical circuit breaker 3, including a circuit breaker terminal lug 2 and a terminal lug cover 1. The electrical circuit breaker 3, a number of the circuit breaker terminal lugs 2 and a number of the terminal lug covers 1 form a circuit breaker apparatus 4. The example circuit breaker 3 includes six example circuit breaker terminals, although the disclosed concept is applicable to circuit breakers having any suitable number of circuit breaker terminals. As shown in the embodiment of FIG. 1, three terminals are on a top (with respect to FIG. 1) portion of the circuit breaker 3, and three terminals are on a bottom (with respect to FIG. 1) portion thereof Five of the circuit breaker terminals are shown as being assembled, having a terminal lug cover 1 shown affixed to a terminal lug 2. The terminal lugs 2 (only one is shown in FIG. 1, it being understood that each of the circuit breaker terminals includes a terminal lug 2) and associated and respective terminal lug covers 1 are shown as assembled with the circuit breaker 3 in five of the six terminal assemblies of FIG. 1. A sixth terminal assembly of FIG. 1 shows the terminal lug 2 and the terminal lug cover 1 in exploded fashion, shown in an "unassembled" arrangement (i.e., unassembled from the circuit breaker 3).

As shown in FIG. 1, each terminal lug 2 includes a number of terminal lug screws 5 that are used to secure a number of circuit breaker cables (not shown) to each terminal lug 2. The terminal lug cover 1 includes an access hole 6 which allows for a screwdriver or similar tool (not shown) to tighten the number of terminal lug screws 5 to the number of cables (not shown). In one embodiment, as shown in FIG. 1, the terminal lug cover 1 includes a lower flange 7 and securing clips 8. The lower flange 7 and securing clips 8 are used in assembling and affixing the terminal lug cover 1 to the terminal lug 2.

The terminal lug 2 can be made of copper, aluminum or any other suitable conductor for a circuit, such as a power circuit.

The terminal lug cover 1 can be made of a suitable thermoplastic material (e.g., without limitation, LEXAN® 500 10% glass filled V0 rated).

The terminal lug cover 1 advantageously couples to a portion of the terminal lug 2 external to the circuit breaker 3. The terminal lug 2 is removable from the circuit breaker 3. The upper (with respect to FIG. 1) portion of the terminal lug 2 and the terminal lug cover 1 coupled thereto are both external to the circuit breaker 3. The terminal lug 2 electrically and mechanically connects to one of the line or load conductors (not shown) of the circuit breaker 4 via a terminal mounting screw (not shown).

Figure 2:
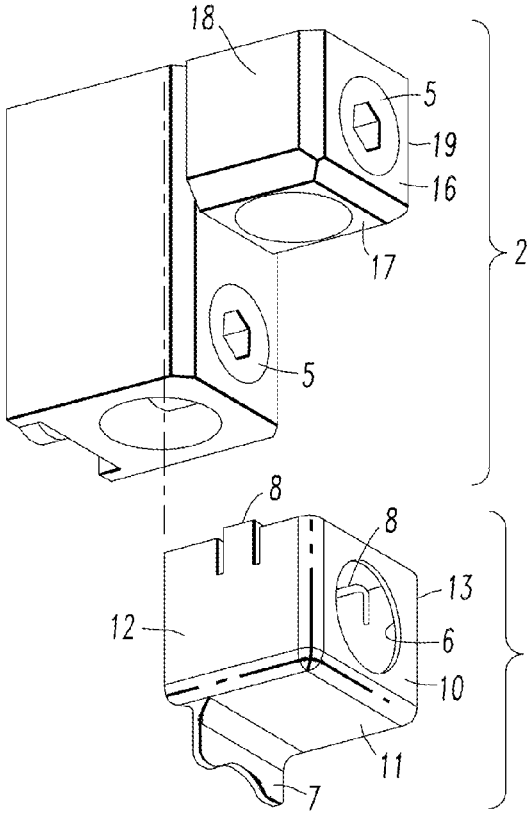
FIG. 2 is an exploded isometric view of the terminal lug and the terminal lug cover of FIG. 1.

FIG. 2 shows an exploded isometric view of the terminal lug 2 and the terminal lug cover 1. As shown in FIG. 2, the terminal lug 2 includes two terminal lug screws 5 used to secure a number of cables (not shown) to each terminal. The embodiment of FIG. 2 further shows the terminal lug cover 1 including the securing clips 8. The securing clips 8 extend from a top (with respect to FIG. 2) portion of the terminal lug cover 1. In the embodiment shown, the terminal lug cover 1 includes the flange 7 extending therefrom. The access hole 6 is provided through the terminal lug cover 1 as shown in FIG. 2. The access hole 6 permits access to a number of the terminal lug screws 5, which are in turn used to couple cabling (not shown) to a respective circuit breaker terminal (not shown) positioned within the circuit breaker.

Figure 3:
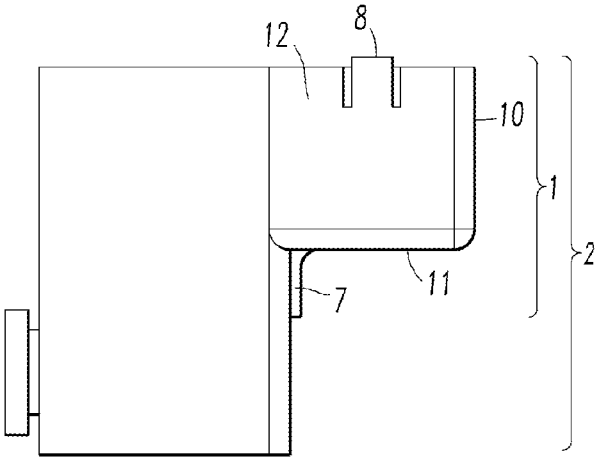
FIG. 3 is a side profile view of a fully assembled terminal lug cover mechanically coupled to and assembled to the terminal lug of FIG. 2.

FIG. 3 shows a side profile view of the fully assembled terminal lug cover 1 mechanically coupled to and assembled to the terminal lug 2. In the embodiment shown in FIG. 3, a side profile of the terminal lug 2 is visible. In this embodiment, the terminal lug cover 1 is snugly affixed to the terminal lug 2 via the top (with respect to FIG. 3) securing clips 8 (only one securing clip 8 is shown in FIG. 3). A profile view of the lower (with respect to FIG. 3) flange 7 of the terminal lug cover 1 described above with reference to FIGS. 1 and 2 is shown in contact with a lower (with respect to FIG. 3) half of the terminal lug 2. The terminal lug cover 1 fits snugly on a front side 16, a bottom side 17, and two opposing sides 18,19 (shown in FIG. 2) of the terminal lug 2 in order that physical contact between the terminal lug cover 1 and the terminal lug 2 permits the terminal lug cover 1 to conduct heat away from the terminal lug 2 and the number of cables (not shown) and/or deflect ionized gases away from the terminal lug 2.

Figure 4:
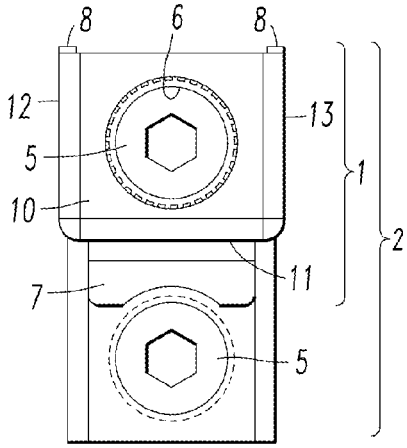
FIG. 4 is a front profile view of the terminal lug cover shown mechanically affixed and assembled to the terminal lug of FIGS. 1-3.

FIG. 4 is a front (with respect to FIGS. 1 and 4) profile view of the terminal lug cover 1 of FIGS. 1-3 shown mechanically affixed and assembled to the terminal lug 2 described above with reference to FIGS. 1-3. The embodiment of the terminal lug cover 1 shown in FIG. 4 comprises four sides 10,11,12,13, the securing clips 8 described above with reference to FIGS. 1-3, the lower (with respect to FIG. 4) flange 7, and the access hole 6 located on the front (with respect to FIG. 4) side 10 of the terminal lug cover 1. As described above with reference to FIGS. 1 and 2, the access hole 6 allows access to a number of the terminal lug screws 5 by a screwdriver or similar tool (not shown). As described above, the number of terminal lug screws 5 may be used to secure a number of connecting cables (not shown) to the terminal lug 2.

Figure 5:
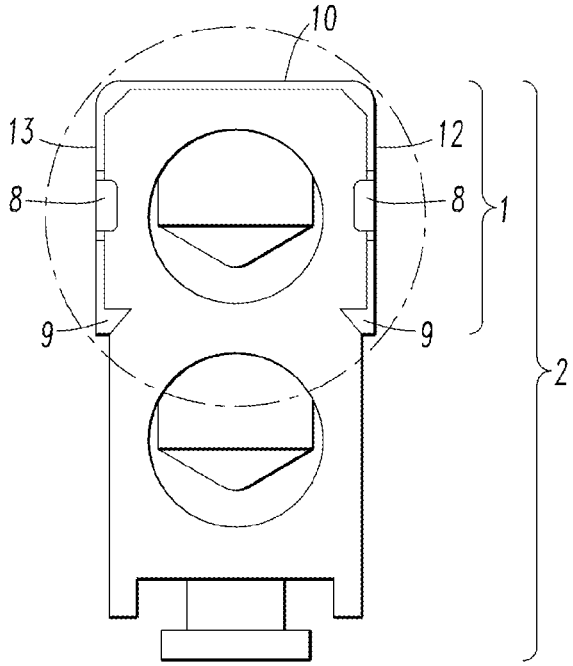
FIG. 5 is a top plan view of the terminal lug cover affixed and assembled to the terminal lug of FIGS. 1-4.

FIG. 5 shows a top (with respect to FIGS. 1 and 5) plan view of the terminal lug cover 1 affixed and assembled to the terminal lug 2 described above with reference to FIGS. 1-4. As shown in FIGS. 3-5, three 10,12,13 of the four sides 10,11,12,13 of the terminal lug cover 1 are shown affixed to the terminal lug 2. The securing clips 8 described above with reference to FIGS. 1-4 help secure the terminal lug cover 1 to the terminal lug 2. As shown in FIG. 5, one embodiment of the terminal lug cover 1 also includes additional securing clips 9 that span the vertical (with respect to FIG. 1) length of the rear (with respect to FIG. 1) portion of the terminal lug cover 1. In this embodiment, the additional securing clips 9 help to further secure and mechanically affix the terminal lug cover 1 to the terminal lug 2. In one embodiment, the additional securing clips 9 interface with and couple to a chamfered edge 14 (a top portion of which is best shown in FIG. 6) of the terminal lug 2 wherein the chamfered edge 14 is structured to mechanically couple to the additional securing clips 9.

Figure 6:
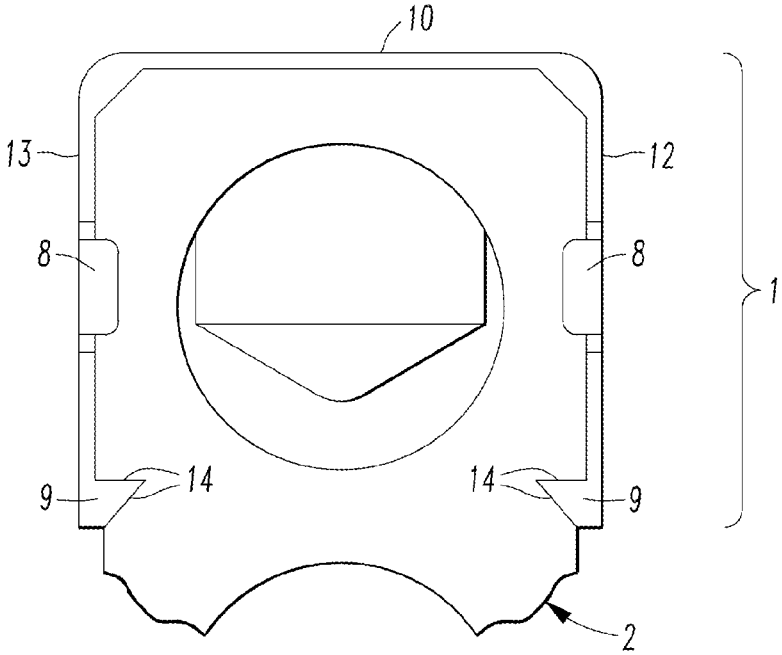
FIG. 6 is a top plan view of the terminal lug cover affixed to the terminal lug of FIG. 5, except magnified to show details of the terminal lug and the terminal lug cover.

FIG. 6 is a top (with respect to FIGS. 1, 5 and 6) plan view of the terminal lug cover 1 affixed to the terminal lug 2 of FIG. 5, except magnified to show the terminal lug cover 1 in more detail. In this embodiment, a top (with respect to FIG. 1) portion of the terminal lug 2 is shown mechanically coupled to the terminal lug cover 1. Three 10,12,13 of the four sides 10,11,12,13 of the terminal lug cover 1 are in view, as well as the securing clips 8 and additional securing clips 9.

The disclosed terminal lug cover 1 protects the terminal lug 2 against relatively high temperature exhaust gasses after the circuit breaker 3 has interrupted the corresponding circuit (not shown). The terminal lug cover 1 protects against erosion of the terminals of the terminal lugs 2 from melted terminal material caused by high temperature gases exiting the circuit breaker 3. Since terminals and lug screw threads can otherwise be damaged to a point where the cabling would need to be cut in order to change out the product, the disclosed solution can help avoid potentially costly repairs, beyond a simple circuit breaker replacement.

The disclosed terminal lug cover 1 assembles to the profile of the circuit breaker terminal lug 2, with securing clips 8 and/or 9 to hold the cover in position. The cover 1 allows access to a number of the circuit breaker terminal lug screws 5 in order to connect cabling. The cover 1 then deflects ionized gases away from the body of the terminal lug 2.

In view of what is described above, one skilled in the art will understand that the embodiments of the assembly thus far described comprise the circuit breaker 3, the circuit breaker terminal lug 2, and the terminal lug cover 1. One embodiment of the disclosed concept utilizes a terminal lug cover, such as 1, having four sides 10,11,12,13 with the lower (with respect to FIG. 1) flange 7 and the top (with respect to FIG. 1) securing clips 8 as well as the rear (with respect to FIG. 1) securing clips 9 and the circular hole 6 in the face allowing for the terminal lug screw 5 to pass through and connect to the terminal. The characteristics of the terminal lug cover 1 function to affix securely to the terminal lug 2 and carry heat away from the terminal lug 2 and connecting cables (not shown) through physical contact and/or function as a shield and deflect ionized gases away from the terminal lug 2. The gases deflect off of the shield, thereby preventing the heat of the gases from melting the terminal's material and the cable's insulation/conductor material. Preferably, the material of the terminal lug cover 1 includes a suitable fire retardant component (e.g., without limitation, a V0 fire retardant component).

One skilled in the art may find advantages by using a mechanism different than the securing clips 8 and/or 9 to fasten the terminal lug cover 1 to the terminal lugs 2. One skilled in the art may also find advantages by using a different type of hole than the circular hole 6 on the front (with respect to FIG. 1) side 10 of the terminal lug cover 1 to permit the terminal lug screw 5 to pass through such cover. One skilled in the art may also find advantages by using more or fewer sides for the terminal lug cover 1. One skilled in the art may also find advantages by changing the shape and orientation of the flange 7 such that it may not exist at all, or in the alternative, may extend the full length of the lower (with respect to FIG. 1) half of the terminal lug 2, while containing an additional access hole or terminal lug screw pass-through feature (not shown).

According to several embodiments, the disclosed concept will extend the life of circuit breaker terminal lugs and connecting cables (not shown) by protecting against degradation and/or corrosion from heat, ionized exhaust gasses or connecting cable melt. These advantageous characteristics of the terminal lug cover 1 will result in substantial cost savings in circuit breaker maintenance.

What has been shown is the circuit breaker terminal lug cover 1. While the terminal lug cover 1 has been described through specific embodiments and applications thereof, it is understood that numerous modifications and variations could be made thereto by those skilled in the art without departing from the spirit and scope of the disclosed concept. It is therefore understood that within the scope of the claims, the disclosed concept may be practiced otherwise than specifically described herein.

Accordingly, it is to be understood that the disclosed concept is not to be limited by the specific illustrated embodiments, but only by the scope of the appended claims. The description may provide examples of similar features as are recited in the claims, but it should not be assumed that such similar features are identical to those in the claims unless such identity is essential to comprehend the scope of the claim. In some instances, the intended distinction between claim features and description features is underscored by using slightly different terminology.

The disclosed concept is described in association with a molded case circuit breaker, although the disclosed concept is applicable to a wide range of circuit breakers.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A circuit breaker terminal lug cover structured to mechanically secure to a circuit breaker terminal lug and protect the terminal lug from degradation or corrosion, the terminal lug including more than one terminal lug screw capable of securing a number of cables to the circuit breaker, said terminal lug cover comprising:

a plurality of sides structured to carry heat away from the terminal lug or deflect ionized gases away from the terminal lug, said plurality of sides comprising:

a first side, a second side opposite and spaced from said first side, a third side extending from said first side to said second side, said third side including a single access hole permitting access to at least one of terminal lug screws, and a fourth side extending from said first side to said second side, said fourth side being normal to said third side, wherein at least one of said first side and said second side includes a number of securing members structured to mechanically secure the terminal lug cover to the circuit breaker terminal lug, and wherein the access hole is centrally disposed on said third side and spaced from each of said first side and said second side.

2. The circuit breaker terminal lug cover of claim 1 wherein said terminal lug cover is made of a thermoplastic.

3. The circuit breaker terminal lug cover of claim 1 wherein the number of securing members are a plurality of securing clips structured to couple to a top portion of the terminal lug.

4. The circuit breaker terminal lug cover of claim 1 wherein said third side is planar.

5. The circuit breaker terminal lug cover of claim 1 wherein the number of securing members are a plurality of securing clips structured to couple to a rear portion of the terminal lug.

6. The circuit breaker terminal lug cover of claim 5 wherein the plurality of securing clips are further structured to span and couple to a vertical length of the rear portion of the terminal lug.

7. The circuit breaker terminal lug cover of claim 6 wherein the vertical length of the rear portion of the terminal lug is a chamfered edge; and wherein the plurality of securing clips are further structured to mechanically couple to the chamfered edge.

8. A circuit breaker apparatus comprising:

a circuit breaker comprising:

a circuit breaker terminal lug including more than one terminal lug screw capable of securing a number of cables to the circuit breaker; and a circuit breaker terminal lug cover mechanically secured to the circuit breaker terminal lug in order to protect the terminal lug from degradation or corrosion, said terminal lug cover comprising:

a plurality of sides structured to carry heat away from the terminal lug or deflect ionized gases away from the terminal lug, said plurality of sides comprising:

a first side, a second side opposite and spaced from said first side, a third side extending from said first side to said second side, said third side including a single access hole permitting access to at least one of terminal lug screws, and a fourth side extending from said first side to said second side, said fourth side being normal to said third side, wherein at least one of said first side and said second side includes a number of securing members mechanically securing the terminal lug cover to the circuit breaker terminal lug, and wherein the access hole is centrally disposed on said third side and spaced from each of said first side and said second side.

9. The circuit breaker apparatus of claim 8 wherein said terminal lug is made of copper or aluminum.

10. The circuit breaker apparatus of claim 8 wherein the number of securing members are a plurality of securing clips that couple the terminal lug cover to the terminal lug.

11. The circuit breaker apparatus of claim 8 wherein the terminal lug comprises two opposing and spaced apart sides, a front side extending between the two opposing and spaced apart sides, and a bottom side extending between the two opposing and spaced apart sides and being normal to the front side; wherein each of said first side of said terminal lug cover and said second side of said terminal lug cover substantially overlays and engages a corresponding one of the opposing and spaced apart sides of the terminal lug; wherein said fourth side of said terminal lug cover substantially overlays and engages the bottom side of the terminal lug; wherein said third side of said terminal lug cover substantially overlays and engages the front side of the terminal lug; and wherein physical contact between the terminal lug cover and the terminal lug permits the terminal lug cover to conduct heat away from the terminal lug and the number of cables or deflect ionized gases away from the terminal lug.

12. The circuit breaker apparatus of claim 8 wherein said terminal lug cover is made of a thermoplastic.

13. The circuit breaker apparatus of claim 8 wherein the number of securing members are a plurality of securing clips coupled to a top portion or a rear portion of the terminal lug.

14. The circuit breaker apparatus of claim 13 wherein the plurality of securing clips further span and couple to a vertical length of the rear portion of the terminal lug; wherein the vertical length of the rear portion of the terminal lug is a chamfered edge; and wherein the plurality of securing clips mechanically couple to the chamfered edge.

15. The circuit breaker apparatus of claim 8 wherein said terminal lug cover is coupled to a portion of said terminal lug external to said circuit breaker; wherein said terminal lug is removable from said circuit breaker; and wherein the portion of said terminal lug and said terminal lug cover coupled thereto are both external to the circuit breaker.

16. A method of protecting a circuit breaker terminal lug from degradation or corrosion, said circuit breaker terminal lug including more than one terminal lug screw capable of securing a number of cables to a circuit breaker, said circuit breaker including a terminal lug, said method comprising:

mechanically securing a circuit breaker terminal lug cover to the circuit breaker terminal lug in order to protect the terminal lug from degradation or corrosion;

providing said circuit breaker terminal lug cover with a plurality of sides structured to carry heat away from the terminal lug or deflect ionized gases away from the terminal lug, said plurality of sides including a first side, a second side, a third side, and a fourth side, said second side being disposed opposite and spaced from said first side, said third side extending from said first side to said second side, said fourth side extending from said first side to said second side and being normal to said third side;

providing said third side with a single access hole permitting access to at least one terminal lug screw, said access hole being centrally disposed on said third side and spaced from each of said first side and second side and;

including with at least one of said first side and said second side a number of securing members mechanically securing the terminal lug cover to the circuit breaker terminal lug.

17. The method of claim 16 further comprising:

snugly fitting the terminal lug cover on a front, a bottom, and two sides of the terminal lug with said first side, said second side, said third side, and said fourth side;

conducting heat away from the terminal lug and said number of cables from physical contact between the terminal lug and the terminal lug, or deflecting ionized gases away from the terminal lug; and disposing one of said terminal lug screws substantially between one of said number of cables and said third side.

18. The method of claim 16 further comprising:

coupling the terminal lug cover to the terminal lug with a plurality of securing clips from at least one of said first side and said second side.

19. The method of claim 18 further comprising:

coupling the terminal lug cover to a top portion or a rear portion of the terminal lug.

20. The method of claim 18 further comprising:

coupling the plurality of securing clips to a rear portion of the terminal lug.

21. The method of claim 20 further comprising:

spanning and coupling the plurality of securing clips to a vertical length of the rear portion of the terminal lug;

providing the vertical length of the rear portion of the terminal lug with a chamfered edge; and mechanically coupling the plurality of securing clips to the chamfered edge.

* * * * *